United States Patent [19]

Kasahara et al.

[11] Patent Number: 5,010,372

[45] Date of Patent: Apr. 23, 1991

[54] BLACK-AND-WHITE AND COLOR COPIER OPERABLE AT DIFFERENT PROCESSING SPEEDS

[75] Inventors: Nobuo Kasahara; Masayoshi Watanuki, both of Yokohama; Satoru Maeno, Mie; Masato Ohkuni, Ise, all of Japan

[73] Assignees: Ricoh Company, Ltd.; Shinko Electric Co., Ltd., both of Tokyo, Japan

[21] Appl. No.: 398,916

[22] Filed: Aug. 28, 1989

[30] Foreign Application Priority Data

Sep. 2, 1988 [JP] Japan ..... 63-220091

[51] Int. Cl.[5] ..... G03G 21/00

[52] U.S. Cl. ..... 355/313; 355/243; 355/271; 355/327

[58] Field of Search ..... 355/313, 243, 271, 327, 355/202, 277, 235, 326

[56] References Cited

U.S. PATENT DOCUMENTS

| | | | |
|---|---|---|---|
| 4,367,942 | 1/1983 | Ohtsuka | 355/243 |
| 4,571,061 | 2/1986 | Osanai et al. | 355/243 |
| 4,601,568 | 7/1986 | Takano et al. | 355/243 X |
| 4,705,386 | 11/1987 | Ogita et al. | 355/327 |
| 4,723,146 | 2/1988 | Kashara | 355/313 X |
| 4,733,269 | 3/1988 | Kasahara et al. | 355/271 X |

FOREIGN PATENT DOCUMENTS

| | | |
|---|---|---|
| 2201521A | 2/1988 | United Kingdom . |
| 0281055 | of 0000 | European Pat. Off. . |

*Primary Examiner*—A. T. Grimley
*Assistant Examiner*—Thu A. Dang
*Attorney, Agent, or Firm*—Oblon, Spivak, McClelland, Maier & Neustadt

[57] ABSTRACT

In a copying machine for both black-and-white and color, a latent image of an original is formed in a photosensitive device by scanning the original by a scanning optical system and is developed by a black or color toner and is thereafter transferred onto a transfer paper held on transfer device rotated in proximity to the photosensitive device to provide a copy of the original. The copying machine includes a first drive unit for driving the scanning optical system; a second drive unit for driving the photosensitive device; a third drive unit for driving the transfer device; and a drive condition setting device for judging a designated copy mode and for giving the speeds of the respective drive units which are suitable for the designated copy mode.

6 Claims, 5 Drawing Sheets

BLACK-AND-WHITE AND COLOR COPIER OPERABLE AT DIFFERENT PROCESSING SPEEDS

BACKGROUND OF THE INVENTION

1. Field of the Invention

The present invention relates to a copying machine for both black-and-white and color.

2. Description of Related Art

A generally known copying machine has a scanning optical system, a photosensitive means and a transfer means. The scanning operation is repeatedly performed by the scanning optical system so that a latent image of an original is formed by the photosensitive means and developed by a toner. Thereafter, the toner image is transferred onto a transfer paper held on the transfer means rotated in proximity to the photosensitive means to obtain a copy of the original.

In the above-mentioned copying machine, a transfer drum as one of the transfer means is opposed to a photosensitive drum as one of the photosensitive means and contacts this photosensitive drum. In the case of the color copy, a color original image is decomposed into a plurality of colors by a color filter by means of the scanning optical system for scanning the original above the photosensitive drum and the decomposed color image is successively exposed. The latent image of the exposed color image is developed by a relative complementary color toner every exposure, and each color toner image is repeatedly transferred onto the transfer paper held on the transfer drum to obtain a copy thereof. At this time, the transfer paper is rotated while this paper is grasped by a clamper of the transfer drum, and a required number of transferring operations(three times in the case of the full color) are performed.

The colors generally used in the development are composed of yellow(Y), magenta(M) and cyan(C). In the conventional copying machine for both black-and-white and color, a developer of black(BK) is further disposed in addition to developers of such three colors so as to provide a copy of black and white colors as well as the copy of the full color.

There is a difference between the full color copy and the copy of the black and white colors with respect to the construction as to whether the color filter is used in the exposure or not. Accordingly, in the case of the same exposure amount, the light amount of an image formed on the photosensitive body is different between the full color copy and the copy of the black and white colors.

Therefore, in the case of the copy of the black and white colors, the exposure is performed through a filter to reduce the light amount to be similar to the full color copy, and a voltage applied to an exposure lamp is increased in the case of the color copy such that the light amount on the photosensitive body is set to be equal to that in the case of the copy of the black and white colors. Such an operation has a lot of loss in control.

It is not necessary to control the exposure amount if process speeds such as respective drum circumferential speeds are changed in the cases of the full color copy and the copy of the black and white colors.

However, in the conventional color copying machine, the photosensitive drum and the transfer drum are connected to each other by gears to provide an integrally associated drive system. Accordingly, the copy processing can be executed only at a single process speed.

This is because it is difficult to switch more than two kinds of process speeds by the engagement of the gears, the slip of clutches, etc.

Japanese Laid-Open Patent Publication No. 62-187365 discloses a color copying machine for servo-controlling the photosensitive drum, the transfer drum and the scanning optical system by separate motors.

Such a color copying machine is provided with a scanning optical system, a first motor for driving the scanning optical system, a photosensitive means, a second motor for driving the photosensitive means, a transfer means, and a third motor for driving the transfer means.

In the above color copying machine of the Japanese publication, the motors are separately disposed with respect to the photosensitive means and the transfer means so that the connecting gears and the clutches as in the conventional copying machine are not disposed. Accordingly, in such a copying machine, it is possible to change the process speeds in principle.

However, the above technique is applied to a copying machine having only a full color copying function. Accordingly, such technique does not disclose a copying machine having functions of both the full color copy and the copy of the black and white colors, in which the process speeds are suitably switched corresponding to at least two kinds of required copy modes.

SUMMARY OF THE INVENTION

It is therefore an object of the present invention to provide a copying machine for both black-and-white and color for arbitrarily making a copy of the black and white colors and a full color copy by changing the process speeds corresponding to the respective copy modes of the full color copy, the black-and-white copy, etc., without performing a complicated control having a lot of loss in operation with respect to the exposure amount.

The above object of the present invention can be achieved by a copying machine for both black-and-white and color in which a latent image of an original is formed in a photosensitive device by scanning the original by a scanning optical system and is developed by a black or color toner and is thereafter transferred onto a transfer paper held on a transfer device rotated in proximity to the photosensitive device to provide a copy of the original; the copying machine comprising a first drive unit for driving the scanning optical system; a second drive unit for driving the photosensitive device; a third drive unit for driving the transfer device; a drive condition setting device for judging a designated copy mode and for giving the speeds of the respective drive units are suitable for the designated copy mode.

The scanning optical system, the photosensitive device and the transfer device are separately operated in an operating condition according to the designated copy mode.

Further objects and advantages of the present invention will be apparent from the following description of the preferred embodiments of the present invention as illustrated in the accompanying drawings.

DESCRIPTION OF THE PREFERRED EMBODIMENTS

The preferred embodiments of a copying machine for both black-and-white and color in the present invention will now be described in detail with reference to the accompanying drawings.

Figure 2:
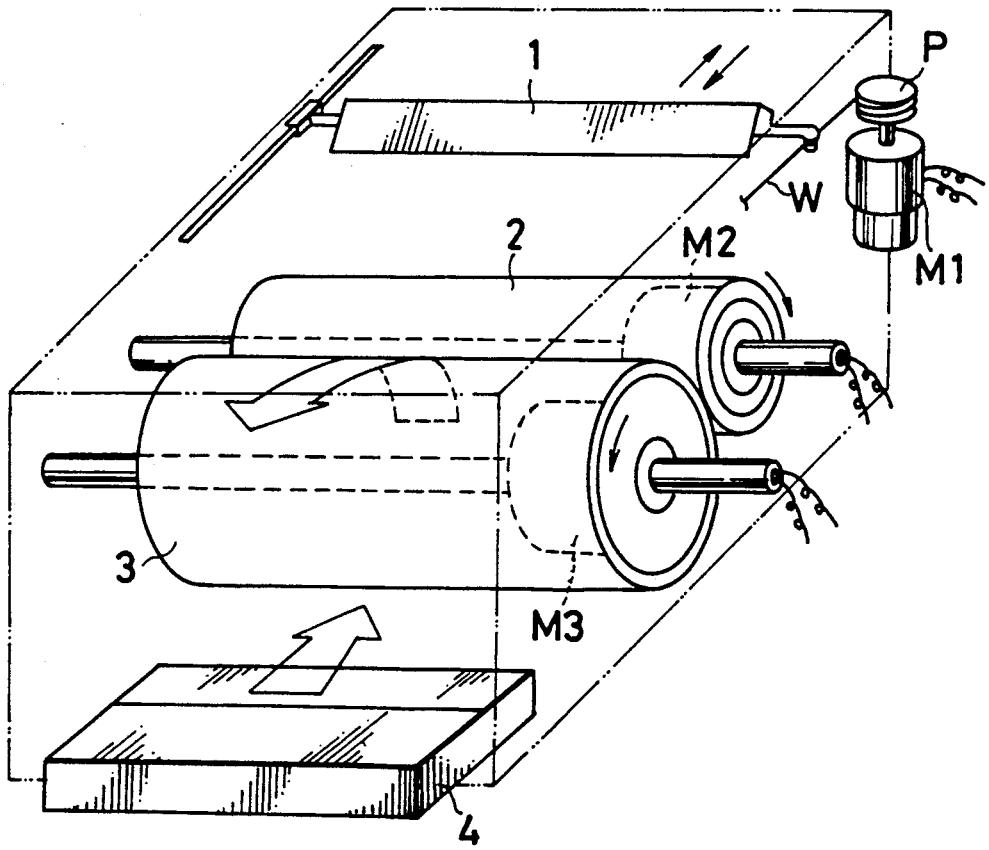
FIG. 2 is a perspective view for explaining a main portion of the copying machine of the present invention.

FIG. 2 shows a main portion of the copying machine for both black-and-white and color in accordance with one embodiment of the present invention. In this figure, reference numeral 1 designates a scanning optical system, 2 a photosensitive drum as a photosensitive means, and reference numeral 3 designates a transfer drum as a transfer means.

A glass plate for an original base is disposed above the scanning optical system 1 although this construction is not shown in FIG. 2. This scanning optical system 1 is reciprocated in the directions of the arrows from a home position on one end side thereof in the copying operation to scan an original arranged on the glass plate for the original base.

The reciprocating movement of the scanning optical system 1 is performed by driving a first motor M1 disposed in the copying machine body. As is well known, this drive mechanism is constructed by a pulley P attached onto a motor shaft, a wire W wound around this pulley P, running blocks or pulleys composed of other unillustrated pulleys, etc.

In the case of a full color copy mode, a color original is repeatedly scanned by the scanning optical system 1 and this color is decomposed into a plurality of colors and the decomposed colors are successively exposed onto the photosensitive drum 2 rotated at a constant speed. A latent image formed on this photosensitive drum 2 is developed every formation thereof by any one of developers having toners respectively composed of yellow(Y), magenta(M) and cyan(C) as corresponding complementary colors. Thereafter, the developed image is repeatedly transferred onto a transfer paper S held by the transfer drum 3 rotated in proximity to the photosensitive drum 2, thereby obtaining a full color copy by the respective toners.

The transfer paper S is sent out of a paper feed portion 4 in advance and is wound around the transfer drum 3.

In the full color copy mode, a suitable color decomposing filter is disposed every scanning operation on an optical path toward the photosensitive drum 2 at the same time when this mode is set. In a black-and-white copy mode, this color decomposing filter is moved away from the optical path.

Commands of the copy mode are given by the switching operation of a switch on an operation panel.

The respective developers of yellow(Y), magenta(M) and cyan(C) are arranged around the photosensitive drum 2. A developer of black(BK) is additionally disposed to provide the black-and-white copy mode.

The photosensitive drum 2 is driven by a second motor M2 attached into this drum.

Figure 4:
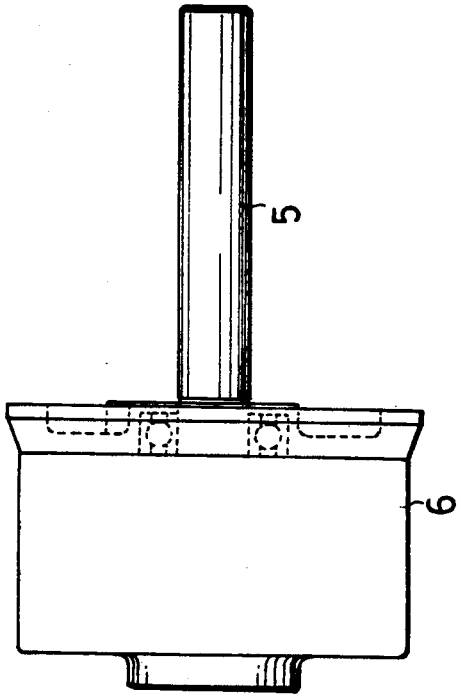
FIG. 4 is a front view of a drum-in motor in the copying machine of the present invention.

This second motor M2 is directly driven by a motor of an outer rotor type called a drum-in motor. The outer shape of this motor M2 is provided as shown in FIG. 4. A shaft 5 of the motor M2 is fixed as shown in FIG. 2 and this motor M2 is constructed by a multipolar AC motor having a structure in which an outer rotor portion 6 fixed to an inner diametric portion of the above drum is rotated.

Similar to the case of the above photosensitive drum 2, the transfer drum 3 is driven by a third motor M3 of the same type.

Figure 1:
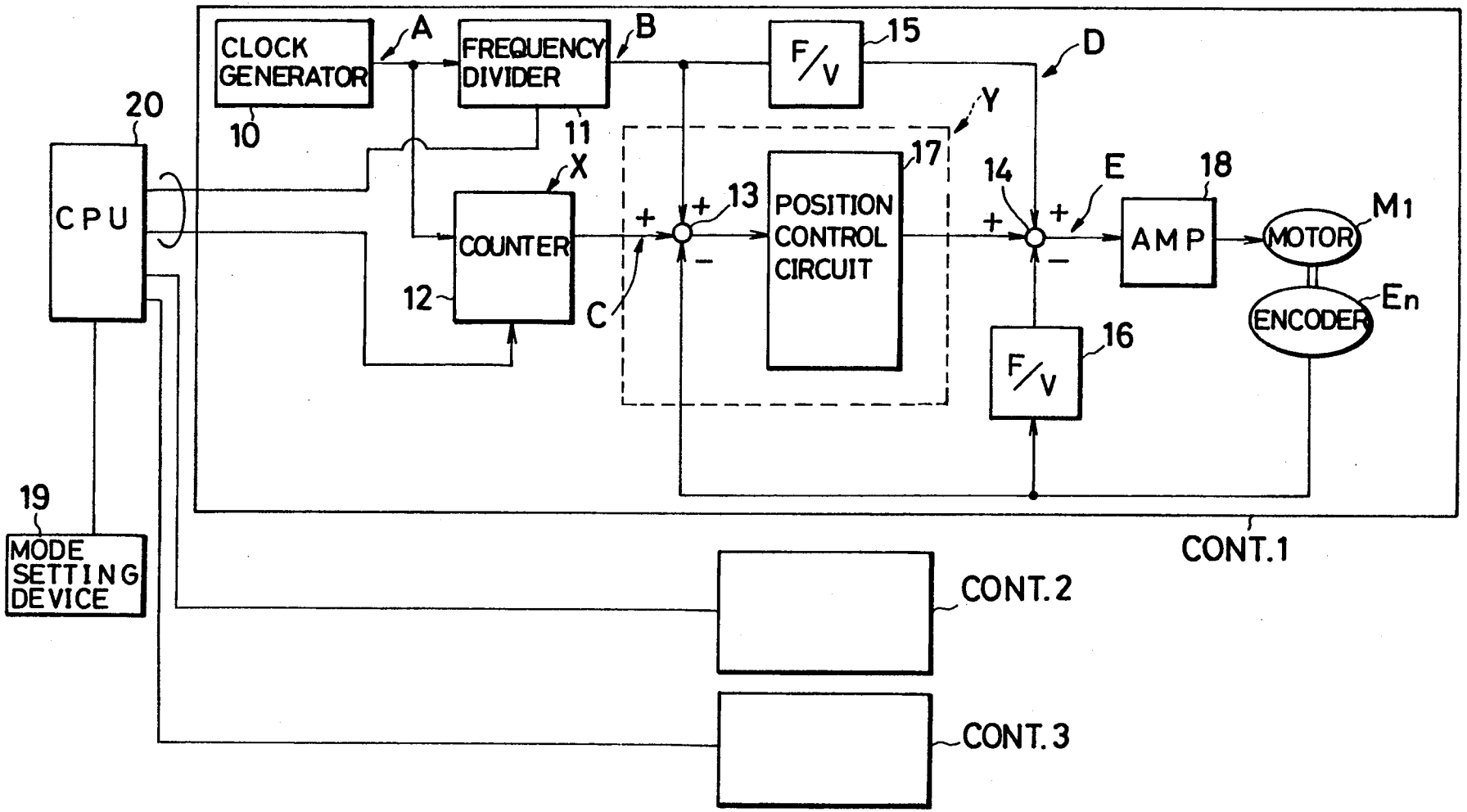
FIG. 1 is a block diagram showing a control system of a copying machine for both black-and-white and color in one embodiment of the present invention.

In FIG. 1, reference numerals CONT.1, CONT.2 and CONT.3 respectively designate control systems of the first motor M1, the second motor M2 and the third motor M3. Since the constructions of the respective control systems are common, the construction of only the control system CONT.1 is described in the following description and the construction of the other control systems is omitted here.

In the control system CONT.1, an output of a clock generator 10 is inputted to a frequency divider 11 and a preset counter 12. An output from a CPU 20 is also inputted to the frequency divider 11 and the counter 12. An output of the frequency divider 11 is inputted to an adder-subtracter 13 and a frequency/voltage converting circuit 15. An output of the counter 12 is inputted to the adder-subtracter 13. An output of the adder-subtracter 13 is inputted to an adder-subtracter 14 through a position control circuit 17. An output of the frequency/voltage converting circuit 15 is inputted to the adder-subtracter 14. An output of the adder-subtracter 14 is inputted to the first motor M1 through an amplifier 18 to drive this motor. An encoder $E_n$ is directly connected to the first motor M1 and an output of this encoder $E_n$ is inputted to the adder-subtracter 13 and the frequency/voltage converting circuit 16. Further, an output of this frequency/voltage converting circuit 16 is inputted to the adder-subtracter 14. The first motor M1 can be stopped in a desired rotary position and can be driven at a desired speed.

Figure 5:
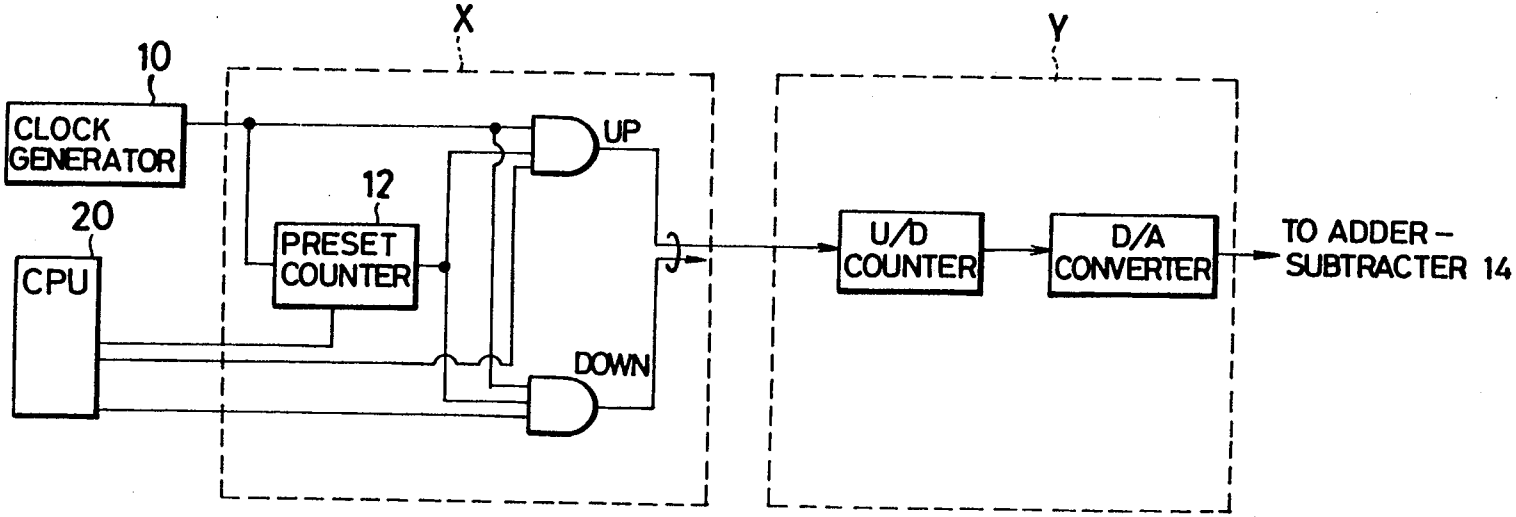
FIG. 5 is a block diagram showing an example of the construction of a counter section and a position control section in FIG. 1.

As shown in FIG. 1, a counter section X including the preset counter 12 is used to correct the rotary position of the motor M1 or perform a skipping operation thereof and can be constructed by a circuit shown in FIG. 5 for example. Namely, the counting number is set by the preset counter 12 according to the corrected or skipped value of the rotary position of the motor. Thus, the rotary position of the motor can be changed by the set number of the counter by enabling the UP or DOWN side in accordance with the accelerated or decelerated direction of the motor.

As shown in FIGS. 1 and 5, a position control section Y for controlling the rotary position of the motor is provided with the adder-subtracter 13 and the position control circuit 17. The position control section Y can be basically constructed by a combination of a U/D counter and a D/A converter.

Figure 6A:
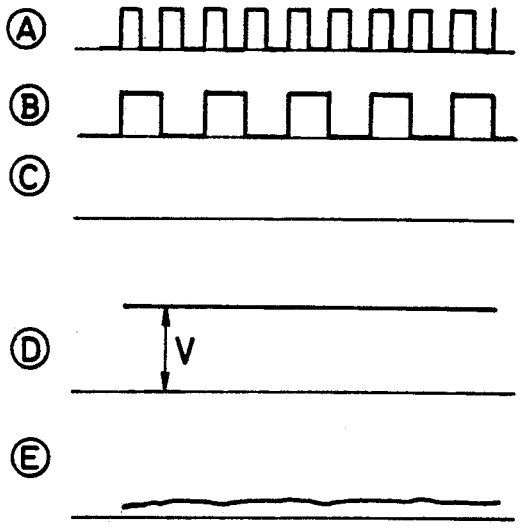
FIGS. 6*a* and 6*b* are views showing signal waveforms in the black-and-white mode and the color mode when no skipping operation of the motor is performed.
Figure 6B:
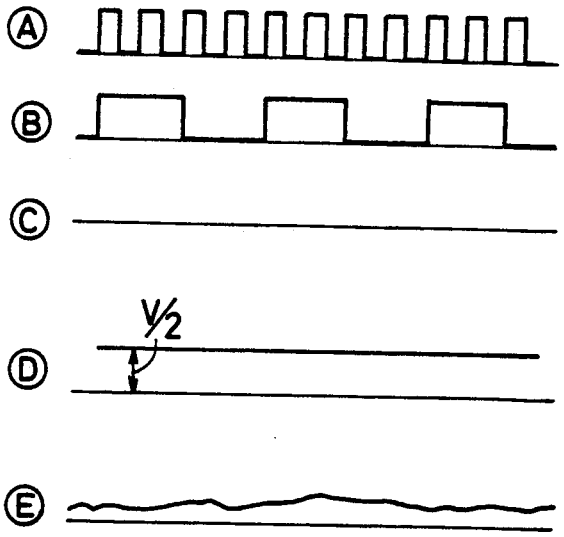
Figure 7:
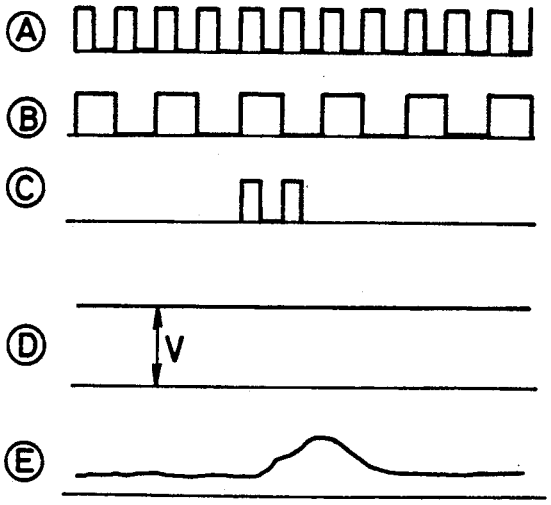
FIG. 7 is a view showing the signal waveforms in the black-and-white mode when the skipping operation of the motor is performed.

The respective constructional elements shown in FIG. 1 generate signal waveforms shown in FIGS. 6 and 7 in accordance with the cases in which the skipping operation of the motor is performed or not. Namely, FIG. 6*a* and 6*b* show the signal waveforms when no skipping operation of the motor is performed. FIG. 6*a* shows the signal waveforms in the case of the black-and-white mode and FIG. 6*b* shows the signal waveforms in the case of the color mode. In the black-and-white mode, the frequency of the output signal from the clock generating circuit 10 is divided into e.g., half by the frequency divider 11. In the color mode, the frequency of the output signal from the clock generating circuit 10 is divided into e.g., one fourth by the frequency divider 11.

In FIGS. 6*a* and 6*b*, item A shows an output waveform of the clock generating circuit 10 in FIG. 1, B an output waveform of the frequency divider 11, C an output waveform of the counter section X, D an output waveform of the frequency/voltage converting circuit 15, and item E shows an output waveform of the adder-subtracter 14. The output voltage of item D in the color mode is half that in the black-and-white mode. The output waveforms E of the adder-subtracter 14 in FIGS. 6*a* and 6*b* show the voltage waveforms corresponding to the difference in output voltage of item D between the black-and-white mode and the color mode.

FIG. 7 shows the signal waveforms when the skipping operation of the motor is performed, and shows two pulses with respect to the output pulses of the counter 12. As shown by the output waveform E of the adder-subtracter 14, the error in output waveform of the adder-subtracter 14 is increased corresponding to these two pulses of the counter 12.

A mode setting device 19 constructs a means for setting the copy mode and corresponds to a key for switching modes on the operation panel of the copying machine.

An output of the mode setting device 19 is inputted to the CPU 20 to give commands about the copy mode.

The CPU 20 corresponds to a computer for controlling the entire processes of the copying machine. In this embodiment, the CPU 20 judges the copy mode designated by the mode setting device 19 and has a function as a means for selecting a drive condition as follows. Namely, this drive condition selecting means selects a frequency dividing ratio of a series of pulses as an output of the clock generator 10 to provide the pulses having a preset frequency so as to provide the respective speeds of the first, second and third motors M1, M2 and M3 suitable for the above designated copy mode.

As shown in FIG. 1, an output of the CPU 20 is inputted to the control systems CONT.1, CONT.2 and CONT.3, respectively. Accordingly, when the copy mode is selected from the mode setting device 19, the first, second and third motors M1, M2 and M3 are respectively controlled through the CPU 20 at suitable speeds according to the respective process speeds in the designated copy mode such as the black-and-white mode and the full color mode, for example.

The process speeds according to various kinds of copy modes will next be shown as an example.

(1) A copy mode by the full color and the same magnification.

In this case, the speed of the first motor M1 is set to V1, and the speed of the second motor M2 is set to V2, and the speed of the third motor M3 is set to V3. These respective speeds of the motors are called reference speeds.

(2) A copy mode by the monochromatic color and the same magnification.

At this time, the respective motors are driven at the reference speeds to perform the copying operation.

(3) A copy mode by the black-and-white and the same magnification.

At this time, the color decomposing filter is not arranged on the optical path of the exposure so that the exposure efficiency is increased in comparison with the color mode. Accordingly, the entire copy process speeds can be increased in comparison with those in the color mode. Therefore, the respective speeds of the motors are uniformly increased in comparison with the above reference speeds.

(4) A copy mode by the full color and zoom, or a copy mode by the monochromatic color and zoom.

At this time, the respective speeds of the second motor M2 and the third motor M3 are the above reference speeds, and the speed of only the first motor M1 is set to a speed different from the reference speed thereof in accordance with the zoom.

(5) A copy mode by the black-and-white and zoom.

At this time, similar to the copy mode of the above item (3), with respect to the second motor M2 and the third motor M3, speeds faster than the above reference speeds are selected. With respect to the first motor M1, a speed different from the reference speed is set in accordance with the zoom.

In the respective modes mentioned above, the monochromatic color is provided by any one of yellow(Y), magenta(M) and cyan(C) to make a color copy.

In the case of the monochromatic color, no color decomposing filter is arranged on the optical path of the exposure so that the copying operation can be performed at process speeds similar to those in the case of the copy of the black and white colors. However, the color developer is designed at the process speed at the time of the full color, and the ratio of rotary speed of the photosensitive drum to the rotary speed of a developing roller is also set in accordance with the process speed at the time of the full color.

Therefore, in the case of the monochromatic color mode, when the copying operation is performed at the same high process speed as that in the black-and-white mode, the speed of the developing roller of the color developer does not conform to that in the monochromatic mode since this speed of the developing roller is set in accordance with the process speed in the case of the full color as mentioned above.

To conform the speed of the developing roller to that in the monochromatic color mode, the rotary speed must be also changed with respect to the developing roller of the color developer. However, the construction of the developer becomes complicated to change the rotary speed of the developing roller. In this embodiment, when the monochromatic color mode is selected by the mode setting device 19, the copying operation is performed at the same process speed as that in the full color mode.

In the above-mentioned embodiment, the photosensitive drum is driven by the second motor M2 as a dedicated drive source and the transfer drum is driven by the third motor M3 as a dedicated drive source, and these drums are independently rotated. Accordingly, there is no restriction that the circumferential ratio of these drums, i.e., the ratio of diameter with respect to these drums, must be an integral magnification, as in the conventional copying machine by the gear connection. Therefore, it is possible to set an arbitrary magnification within a predetermined range of the copying speed.

Motors suitable for the embodiment of the present invention and a servo system relating to the control of these motors will next be described.

(1) Summary of a drum-in servo system

The motors in this servo system have as one example a special structure called a drum-in motor and housing the motor body into the drum and having a motor shaft which is also used as a drum shaft. Such a motor can be constructed such that this motor is integral with the drum. Accordingly, a very advantageous system can be provided in comparison with the other drive units from the viewpoint of the structural design and the control design of the copying machine.

This motor is of an outer rotor type to house the motor body into the drum and is provided with a sensor having a sufficient resolution about pulses so as to sufficiently exert the advantages of the direct drive structure.

In the following description, the drum-in motor is assumed to be constructed such that the number of rotations is 20 rpm and the torque is 5 Kgcm to drive the drum. Then, the servo system simultaneously driving three such motors is described to apply this system to the copying machine.

(2) Construction of the drum-in servo system

This system is assumed to apply this system to the color copying operation and is therefore constructed by three motors composed of two drum-in motors M2, M3, and one DC motor M1. The drum-in motors respectively drive the photosensitive drum and the transfer drum and the DC motor is used to drive the scanning optical system. These three motors have basically the common construction although the drum-in motors are disposed within the drums and the DC motor is not disposed within the drums.

Figure 3:
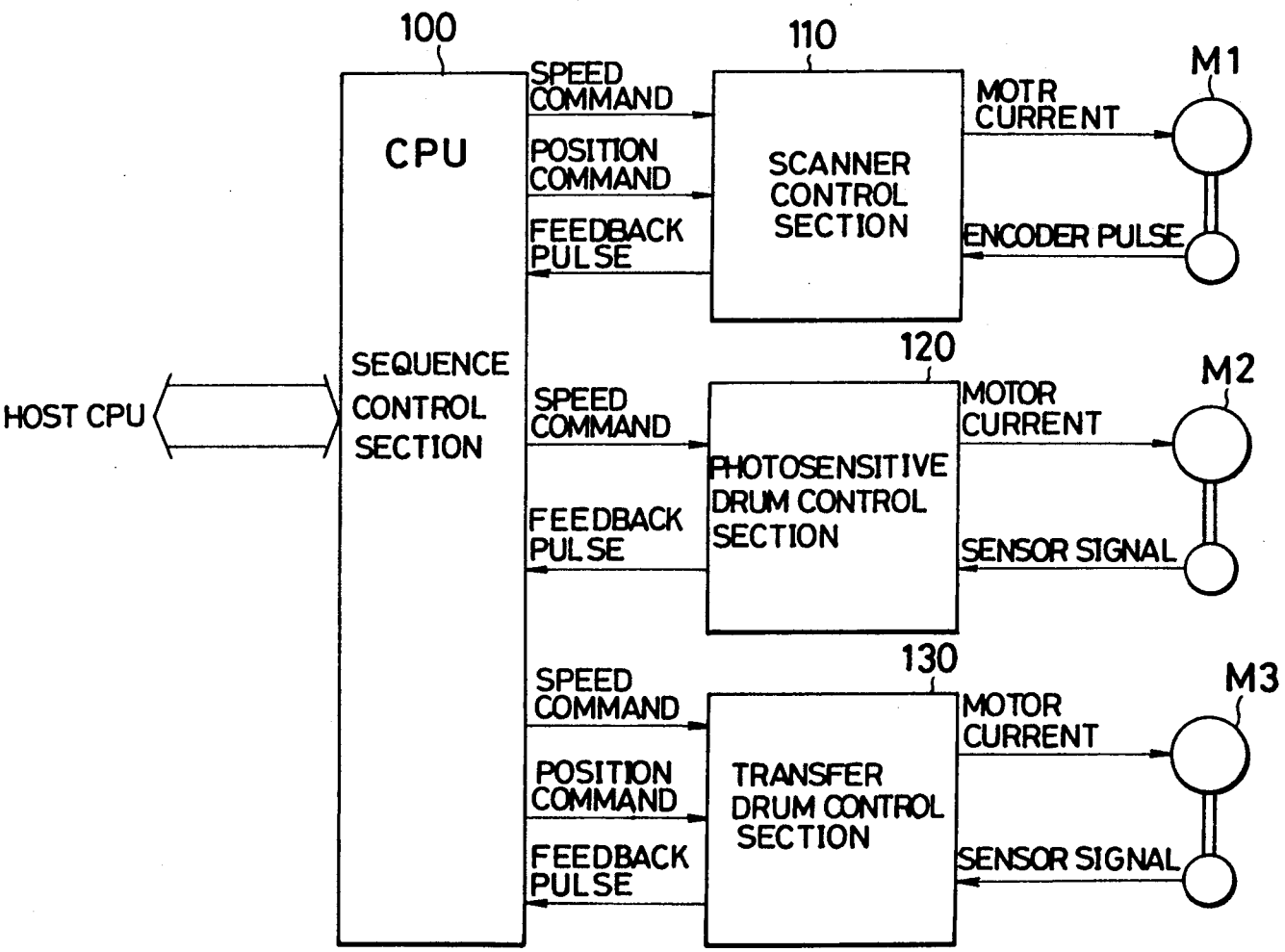
FIG. 3 is a block diagram of a system for controlling motors in the copying machine of the present invention.

In the case of the color copy, to print the three colors by overlapping them each other, the three motors are not independently driven, but must be driven in association with each other so that it is necessary to dispose the CPU 20 for controlling the operation of the three motors. FIG. 3 shows a block diagram of such a structure in this embodiment. A sequence control section 100 and control sections 110, 120, 130 for respectively controlling the three motors M1, M2, M3 are disposed on a single substrate and the outer shape of each motor is shown in FIG. 4.

The features of the motors are as follows.

(1) The copying machine can be made compact since the motors are disposed within the drums.
(2) The copying machine can be quietly driven without any gear sound by the direct drive structure.
(3) The copying machine can be accurately controlled by the direct drive structure.
(4) A sensor having a resolution of at least one hundred thousand pulses has been developed to effectively use the features of the direct drive structure.
(5) It is not necessary to perform the maintenance of the copying machine since no brush is used.

The copying machine is operated by giving various kinds of speed data, scanning length data of the scanning optical system, and commands for starting the copying machine from a host CPU different from the CPU 20. In communication, it is possible to give and take various kinds of data during the copying operation to perform a parallel transmission by an interrupting processing.

In the servo system of the present invention, the drum-in motors are applied to two kinds of drums composed of the photosensitive drum and the transfer drum. The outer diameter of the photosensitive drum is 120 mm and the outer diameter of the transfer drum is 180 mm and is therefore different from that of the photosensitive drum. Accordingly, the attachment structures of the photosensitive drum and the transfer drum are different from each other. However, with respect to the photosensitive drum and the transfer drum, all the parts are common except for an attachment flange and a shaft so that it is possible to simplify the manufacturing processes and reduce the cost of the copying machine.

The characteristics of the drum-in servo system are illustrated as follows when this system is practically applied to the copying machine.

When the drum is driven by a motor with a gear, the rigidity of the gear section and the coupling section is low so that a resonance tends to be generated in a low frequency region and it is difficult to control the operation of this drum at a high speed. In contrast to this, the drum-in motor is directly connected to a load so that an unfavorable resonance is not generated when the motor shaft is firmly fixed, thereby realizing a preferable drive unit. Since the preferable characteristics with no resonance are thus obtained, it is possible to increase the number of copies by skipping the operation of the drum at a high speed. For example, when the size of the paper is small and the unused portion of the transfer drum is large, it is possible to increase the number of copies by skipping this unused portion at a high speed. The motor is rotated at a constant speed such as 12 rpm during the transferring operation, and the rotation of the motor is accelerated until 33 rpm at its maximum at the same time when the transferring operation has been completed and the operation for discharging the transferred paper starts. Then, the rotary operation of the motor is returned to that at the constant speed such as 12 rpm before the next paper discharging operation. The copying efficiency is thus improved by passing through the useless rotary region except for the transferring region at a high speed.

As mentioned above, in accordance with the present invention, a copying machine for both black-and-white and color can make arbitrarily and efficiently a copy of the black and white colors and a full color copy by changing the process speeds corresponding to the respective copy modes of the full color copy, the black-and-white copy, etc., without performing a complicated control having a lot of loss in operation with respect to the exposure amount.

Many widely different embodiments of the present invention may be constructed without departing from the spirit and scope of the present invention. It should be understood that the present invention is not limited to the specific embodiments described in the specification, except as defined in the appended claims.

What is claimed is:

1. A copying machine with a variable process speed having a black-and-white copying mode and color copying mode, comprising:

a scanning optical system for optically scanning an original document, having color filters used in said color copying mode for decomposing color into red, green and blue;

a first drive unit for driving said scanning optical system;

a photosensitive means for obtaining a latent image of said original document, in association with said scanning optical system;

a second drive unit for driving said photosensitive means;

developer means for developing said latent image, having a black developer for developing said latent image obtained without said color filters in said black-and-white copying mode and a yellow developer, a magenta developer and a cyan developer for developing said latent image in respective complementary colors to red, green and blue in said color copying mode;

transfer means rotated in proximity to said photosensitive means and for transferring said developed latent image onto a transfer paper held on a transfer means to provide a copy of the original document;

a third drive unit for driving said transfer means;

a drive condition setting device for judging a designated copy mode and for giving speeds of said respective drive units varying in accordance with respective copy modes, having a pulse generating circuit for generating a series of pulses for controlling operations of said respective drive units, a frequency divider for dividing said series of pulses, and a frequency dividing ratio selecting means for selecting a frequency dividing ratio of said series of pulses to provide a series of divided pulses having a present frequency such that the speeds of the respective drive units are suitable for the designated copy mode; and accelerating means for accelerating said speeds of said respective driving units in order to correct operating positions of said respective drive units, and having counter means for counting a given number of pulses generated by said pulse generating circuit, and an adder means for adding a counted value of said counter means to an output of said frequency divider.

2. A copying machine as claimed in claim 1, wherein process speeds of said copying machine are changed in accordance with respective copy modes.

3. A copying machine as claimed in claim 1, wherein said scanning optical system, said photosensitive means and the transfer means are separately operated in an operating condition according to said designated copy mode.

4. A copying machine as claimed in claim 1, wherein said copying machine further comprises a mode setting device for setting said designated copy mode, and said frequency dividing ratio selecting means judges said designated copy mode designated by said mode setting device.

5. A copying machine as claimed in claim 1, wherein said frequency dividing ratio is changed in accordance with said respective copy modes.

6. A copying machine as claimed in claim 1, wherein said copying machine further comprises a position control circuit for controlling the operating position of each of said respective drive units based on an output of said adder means.

* * * * *